US007077786B2

(12) United States Patent
Chuang et al.

(10) Patent No.: US 7,077,786 B2
(45) Date of Patent: Jul. 18, 2006

(54) ROTOR OF WRIST EXERCISER

(76) Inventors: Yun Yu Chuang, 4F, No. 16, Alley 15, Lane 82, Da Yong Street, San Chong City (TW); Ming Hung Lin, 2F, No. 24, Lane 178, Li Shyng Road Section 1, San Chong City (TW)

( * ) Notice: Subject to any disclaimer, the term of this patent is extended or adjusted under 35 U.S.C. 154(b) by 126 days.

(21) Appl. No.: 10/923,706

(22) Filed: Aug. 24, 2004

(65) Prior Publication Data

US 2006/0046900 A1 Mar. 2, 2006

(51) Int. Cl.
*A63B 23/14* (2006.01)
*A63B 21/22* (2006.01)

(52) U.S. Cl. ..... 482/45; 482/44; 482/110

(58) Field of Classification Search ..... 482/44–50, 482/106, 108, 110; D21/684; 446/233, 235, 446/242, 248, 175, 484; 601/33
See application file for complete search history.

(56) References Cited

U.S. PATENT DOCUMENTS

| | | | | |
|---|---|---|---|---|
| 5,353,655 | A * | 10/1994 | Mishler | 74/5 R |
| 5,356,328 | A * | 10/1994 | Ho | 446/242 |
| 5,766,112 | A * | 6/1998 | Chuan | 482/44 |
| 5,800,311 | A * | 9/1998 | Chuang | 482/44 |
| 6,623,405 | B1 * | 9/2003 | Chuang et al. | 482/44 |
| 6,719,675 | B1 * | 4/2004 | Yu | 482/110 |
| 6,770,012 | B1 * | 8/2004 | Kuo | 482/44 |
| 6,773,377 | B1 * | 8/2004 | Yu et al. | 482/45 |

* cited by examiner

*Primary Examiner*—Stephen R. Crow
*Assistant Examiner*—Allana Lewin
(74) *Attorney, Agent, or Firm*—Rosenberg, Klein & Lee

(57) ABSTRACT

A rotor is rotatably received in a casing to form a wrist exerciser. The rotor includes a spherical body defining a bore in which an inner flange is formed. First and second weight members are received in the bore on opposite sides of the flange. The weight members have inner end portions releasably attached to opposite surfaces of the flange. Through holes are defined in the first and second weight members to receive an axle of which ends project beyond opposite ends of the body to rotatably engage a support ring of the casing.

22 Claims, 10 Drawing Sheets

ROTOR OF WRIST EXERCISER

BACKGROUND OF THE INVENTION

1. Field of the Invention

The present invention generally relates to a wrist exerciser that is held by a palm of a user and having an internal rotor that is caused to rotate by the user exercising his or her wrist muscles, and in particular to a wrist exerciser having a rotor structure that allows for exchange with other rotors having different weights.

2. The Related Art

Wrist exercisers are widely known in exercising and training wrist-related muscles, especially for rehabilitation and therapy purposes. An example of the wrist exercisers is illustrated in U.S. Pat. No. 5,800,311, which provides a device that allows a user to exercise his or her wrist by simply rotating the wrist exerciser with the wrist.

FIG. 10 of the attached drawings shows a conventional wrist exerciser, which is designated with reference character A, comprising a rotor A1 encased in a spherical casing constituted by upper and lower hemi-spherical casing members A2, A3. A circumferential groove A11 is defined around the rotor A1. A hole A12 is defined in the rotor A1 inside the groove A11. The upper casing member A2 defines an opening A21 substantially corresponding in position to the groove A11 for the extension of a rope B. The rope B is wound around the rotor A1 by being received in and extending along the groove A11. When the rope B is quickly withdrawn out of the rotor A1, the friction between the rope B and the rotor A1 causes the rotor A1 to rotate inside the casing.

In order to maintain proper rotation and induce force on the wrist of the user, the rotor A1 must be of a substantial weight. This is usually done by embedding a metal block or metal plate inside the rotor A1, which complicates the manufacturing process of the rotor A1 and increases manufacturing costs. In addition, such a rotor A1 has a fixed weight that cannot be readily changed to accommodate players of different strength. For example, an adult and a child may require rotors of different weight in order to avoid under-training or over-training.

Other known techniques provide rotors made by metal casting. To provide rotors of different weights, different molds are required. This apparently increases the manufacturing costs of the wrist exerciser. In addition, due to the conductivity of the metal rotors, the metal rotors do not allow directly mounting illuminating electronics that gives off light when rotating. Further, adding sensor for counting the turns of rotation to the metal rotors raises another problems for additional machining is needed.

Thus, it is desired to provide a wrist exerciser having a rotor that overcomes the above deficiencies of the conventional wrist exercisers.

SUMMARY OF THE INVENTION

Thus, a primary objective of the present invention is to provide a wrist exerciser comprising a rotor that is constituted by a plurality of separable parts whereby by replacing the parts with counterparts of different weights, the wrist exerciser may accommodate rotors of different weights for different users.

Another objective of the present invention is to provide a wrist exerciser comprising a rotor made of insulation materials whereby illuminating/sounding electronics may be directly attached thereto for giving off light and/or sound during the rotation of the rotor.

To achieve the above objectives, in accordance with the present invention, there is provided a rotor for a wrist exerciser. The rotor comprises a spherical body rotatably received in a casing of the wrist exerciser. The rotor body defines a bore in which an inner flange is formed. First and second weight members are received in the bore on opposite sides of the flange. The weight members have inner end portions releasably attached to opposite surfaces of the flange. Through holes are defined in the first and second weight members to receive an axle of which ends project beyond opposite ends of the body to rotatably engage a support ring of the casing.

BRIEF DESCRIPTION OF THE DRAWINGS

The present invention will be apparent to those skilled in the art by reading the following description of preferred embodiments thereof, with reference to the attached drawings, in which.

DETAILED DESCRIPTION OF THE PREFERRED EMBODIMENTS

Figure 7:
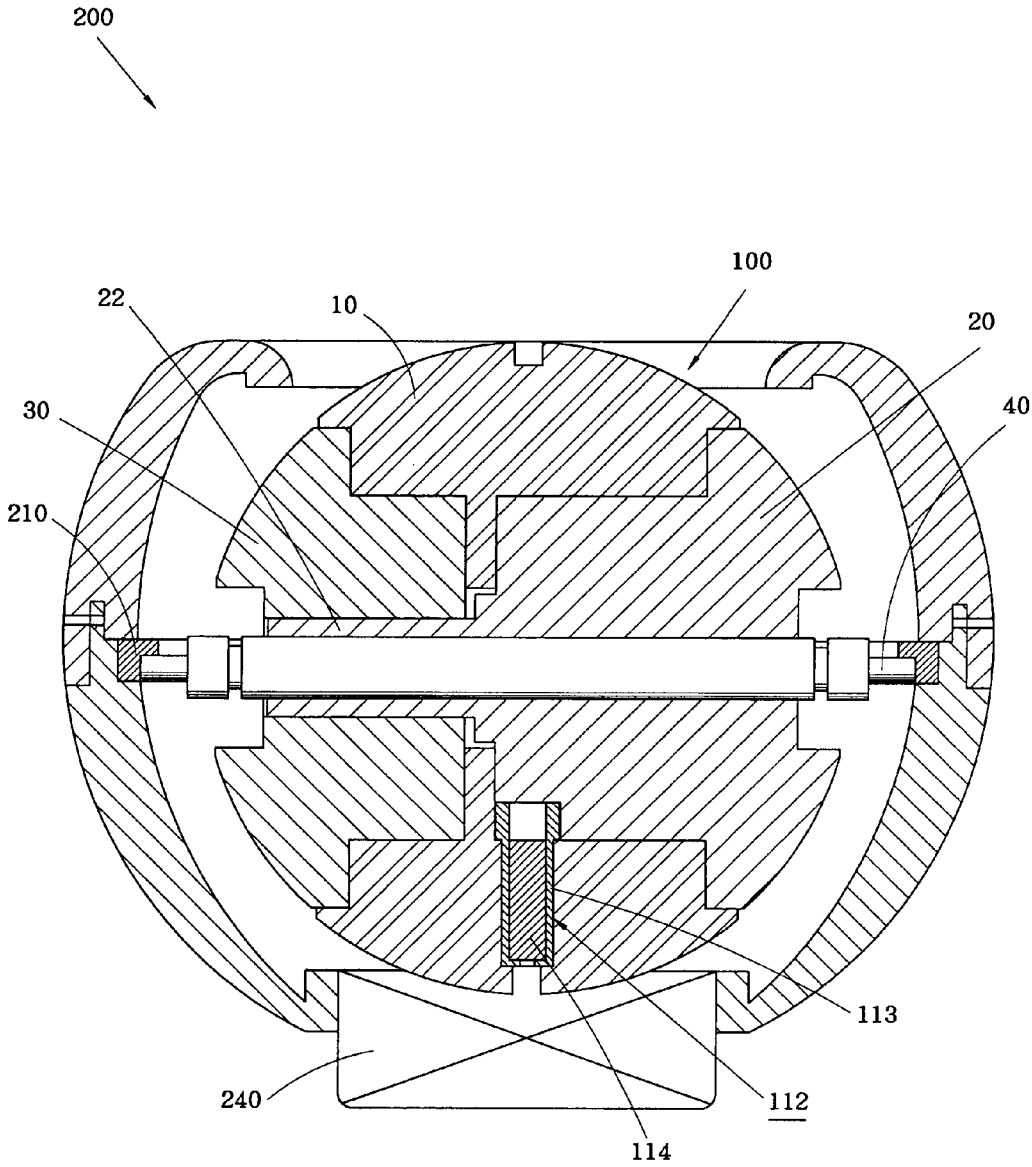
FIG. 7 is a cross-sectional view of a wrist exerciser in which the rotor of the second embodiment of the present invention is incorporated.

With reference to the drawings and in particular to FIGS. 1–4, a rotor constructed in accordance with the present invention, generally designated with reference numeral 100, is to be incorporated in a wrist exerciser 200 (see FIG. 7) for rotation therein when the wrist exerciser 200 is operated by a user (not shown). The rotor 100 comprises a spherical body 10 in which a bore 11 is defined. Removably fixed inside the bore 11 are first and second weight members 20, 30. An axle 40 extends through both the weight members 20, 30 and has ends projecting beyond opposite ends of the body 10 for rotatably engaging a support ring 210 of the wrist exerciser 200 (FIG. 7).

An inner flange 111 is formed inside the bore 11 and extends along an inner circumference of the bore 11. Releasable securing means is provided between the flange 111 and the weight members 20, 30 to fix the weight members 20, 30 inside the bore 11. The securing means comprises first parts 111A that are mounted to opposite surfaces of the inner flange 111 and second parts 211, 311 respectively formed on the weight members 20, 30. The first parts 111A are engageable with the second parts 211, 311 of the first and second weight members 20, 30 and thus securing the weight members 20, 30 inside the bore 11 of the body 10. Examples of the securing means include Velcro fastener and adhesive tapes (especially double-sided adhesive tapes).

The first and second weight members 20, 30, each having a predetermined weight, are sized to fit, preferably snugly, in the bore 11 of the body 10 from opposite ends of the body 10 and thus located on opposite sides of the flange 111. The first and second weight members 20, 30 each have an inner end portion 21, 31 forming a surface opposing the flange 111. The second parts 211, 311 of the securing means are provided on the surfaces of the end portions 21, 31 in correspondence to the first parts 111A of the securing means. Thus, once the first and second weight members 20, 30 are put into the bore 11 of the body 10 with the second parts 211, 311 of the securing means engaging the first parts 111A, the first and second weight members 20, 30 are fixed inside the bore 11.

Each of the first and second weight members 20, 30 also has an outer end portion forming sideway pawls or projections 24, 33 that extend in radial directions and are receivable inside recesses 121 defined in opposite ends of a side wall 12 of the body 10 for properly positioning the first and second weight members 20, 30 inside the bore 11 of the body 10.

The first weight member 20 defines a first through hole 23 through which the axle 40 extends. Preferably, a cylindrical projection 22 extends from the inner end portion 21 of the first weight member 20 toward the second weight member 30. The hole 23 extends completely through the cylindrical projection 22. The second weight member 30 forms a through holes 32 axially aligning with and receiving the cylindrical projection 22 thereby allowing the axle 40 to extend through the second weight member 30. However, it is apparent to those having ordinary skills to omit the cylindrical projection 22 and directly fit the axle 40 into the hole 32 of the second weight member 30 (with the dimension of the axle 40 modified to snugly fit in the hole 32). The axle 40 is of such a length that opposite ends of the axle 40 extend beyond the opposite ends of the body 10.

By means of the releasable engagement between the first parts 111A and the second parts 211, 311 of the securing means, the first and second weight members 21, 31 can be removed from the body 10 for replacement or exchange with a counterpart having a different weight. This allows for change of the overall weight of the rotor 100.

Figure 1:
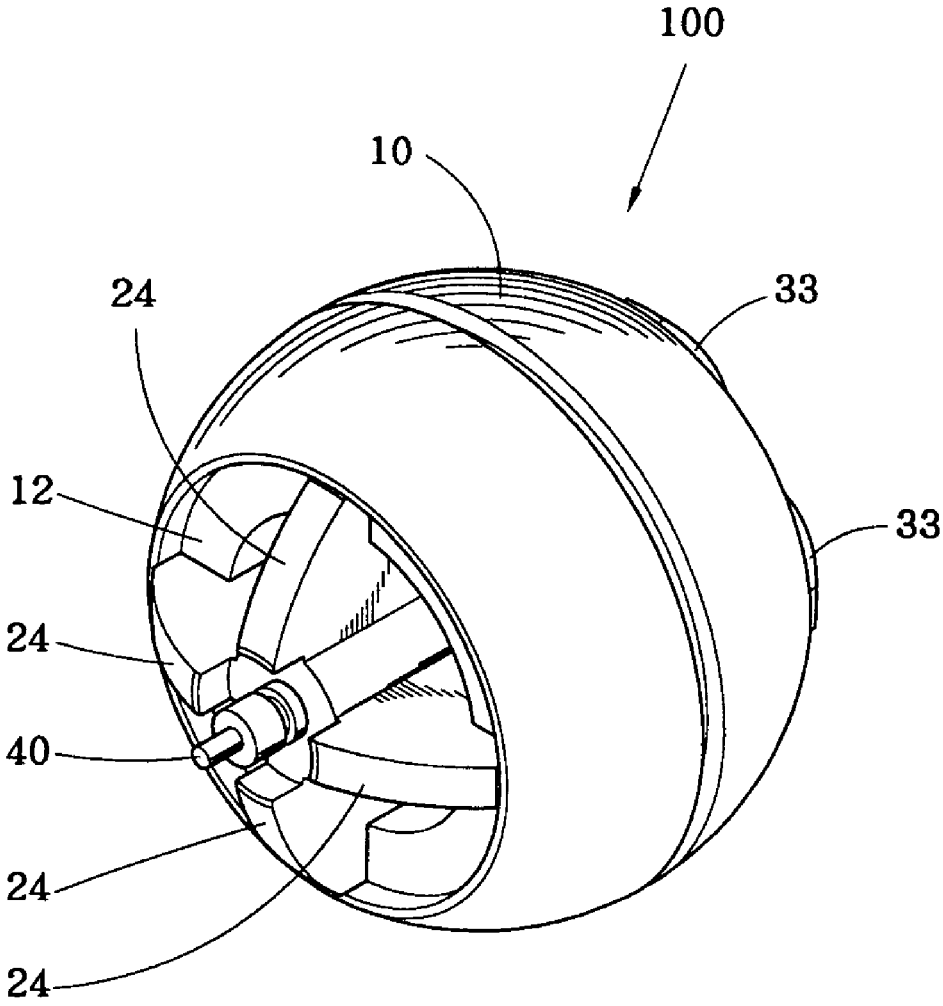
FIG. 1 is a perspective view of a rotor of a wrist exerciser constructed in accordance with a first embodiment of the present invention.
Figure 2:
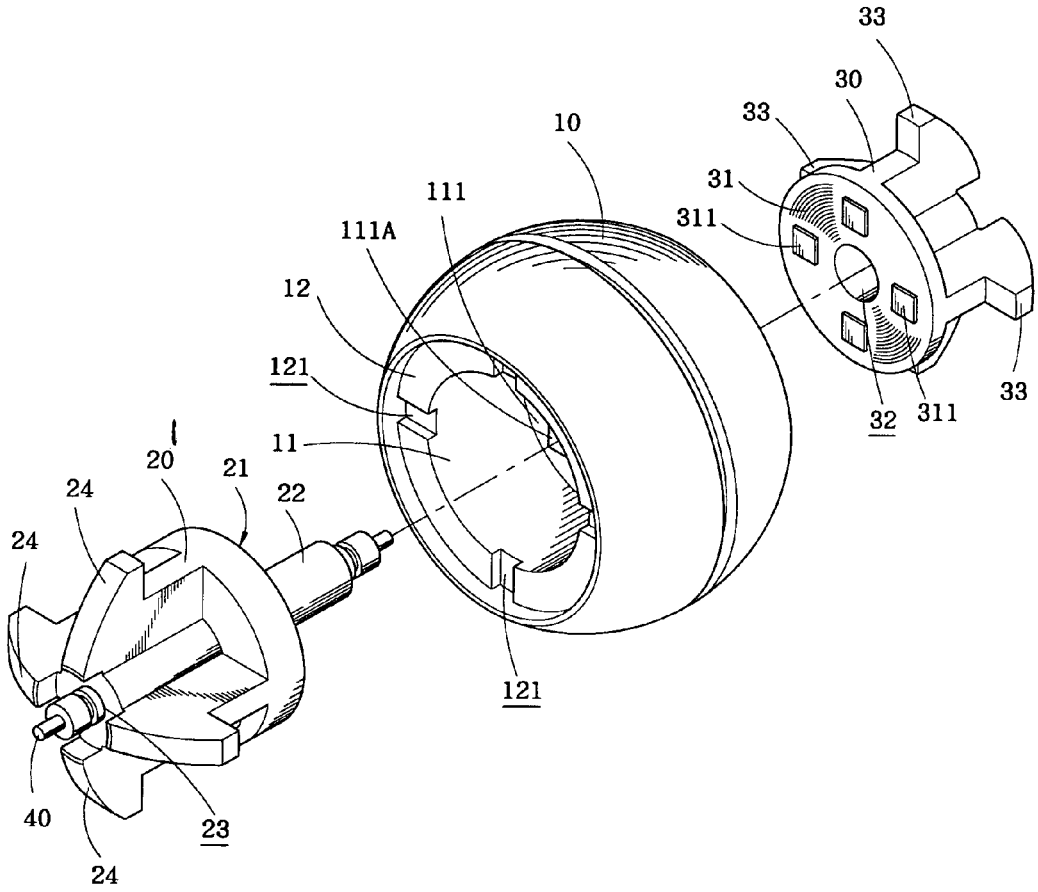
FIG. 2 is an exploded view of the rotor of the present invention.
Figure 3:
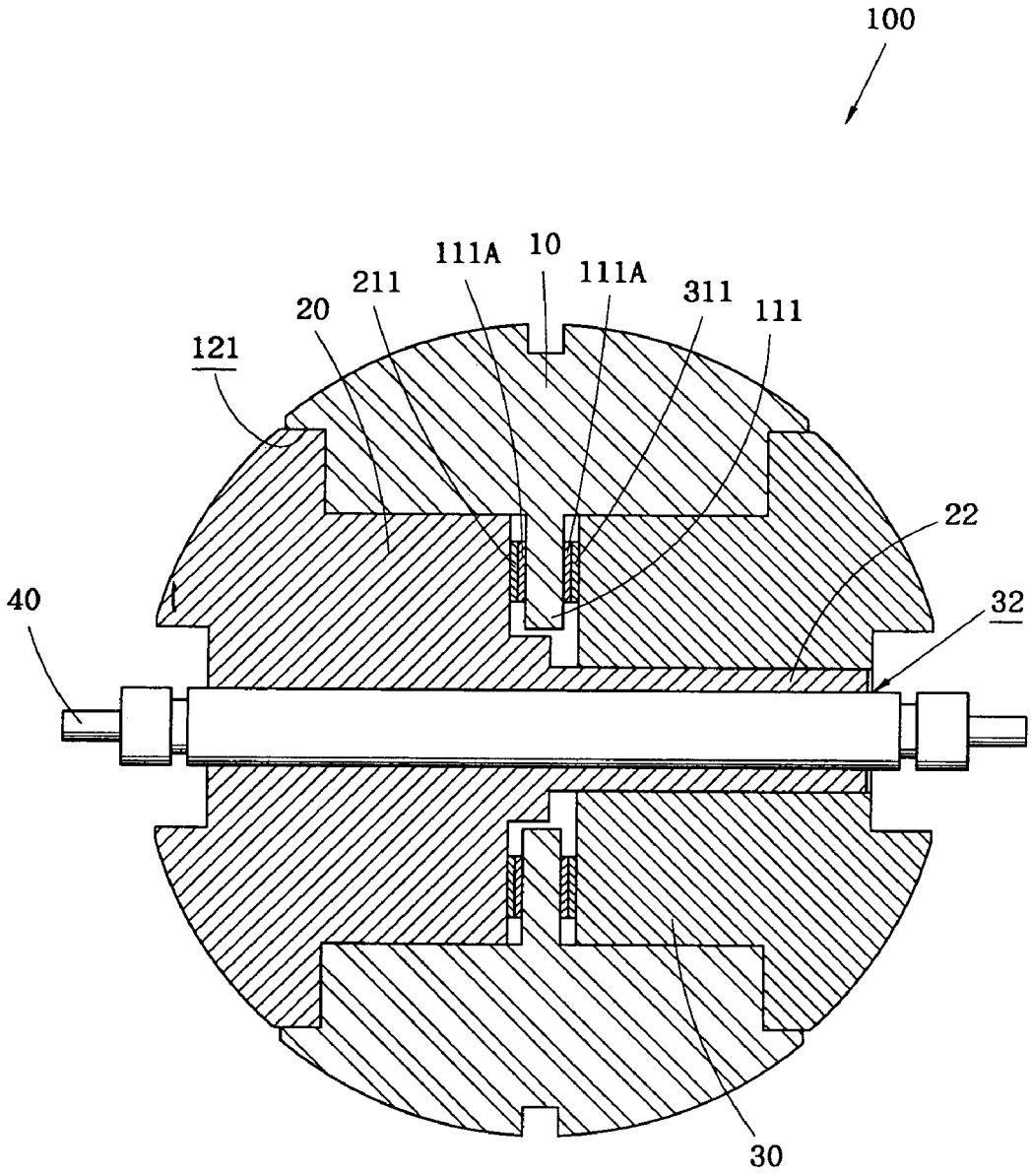
FIG. 3 is a cross-sectional view of the rotor of the present invention.
Figure 4:
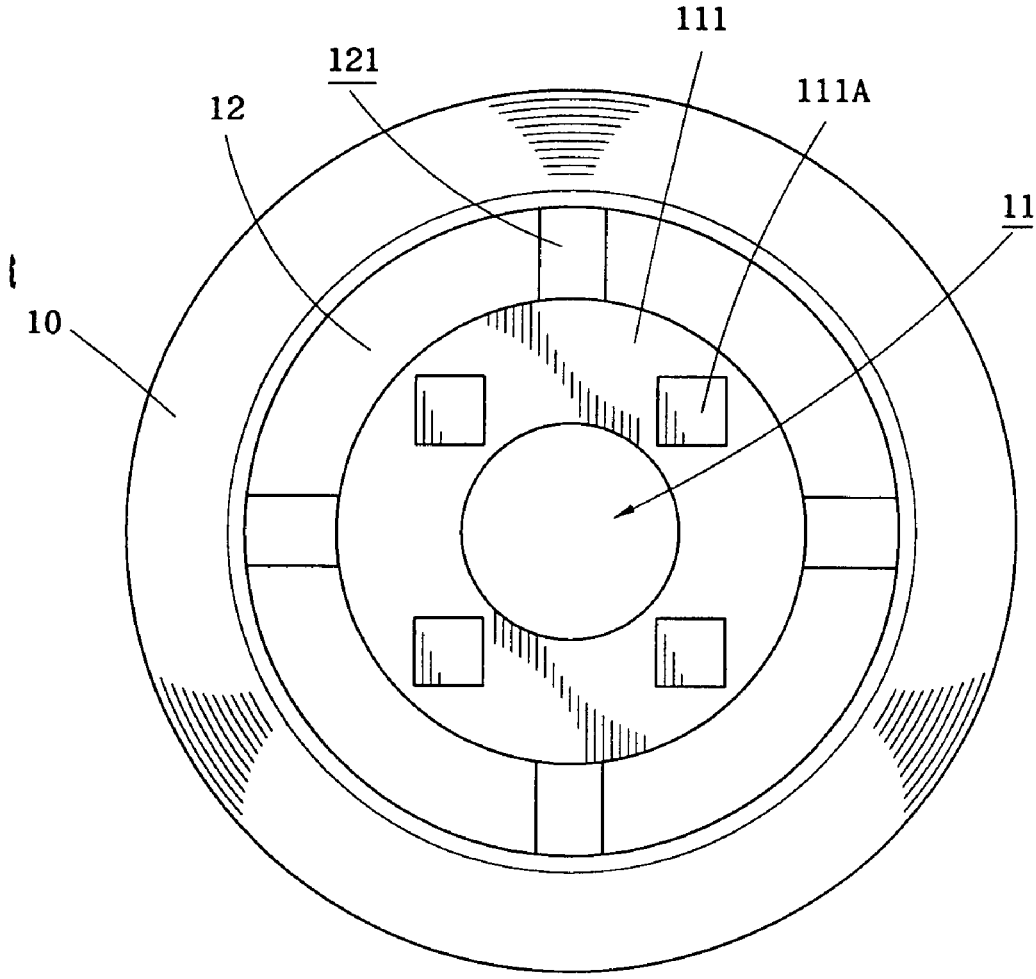
FIG. 4 is an end view of a body of the rotor of the present invention.
Figure 5:
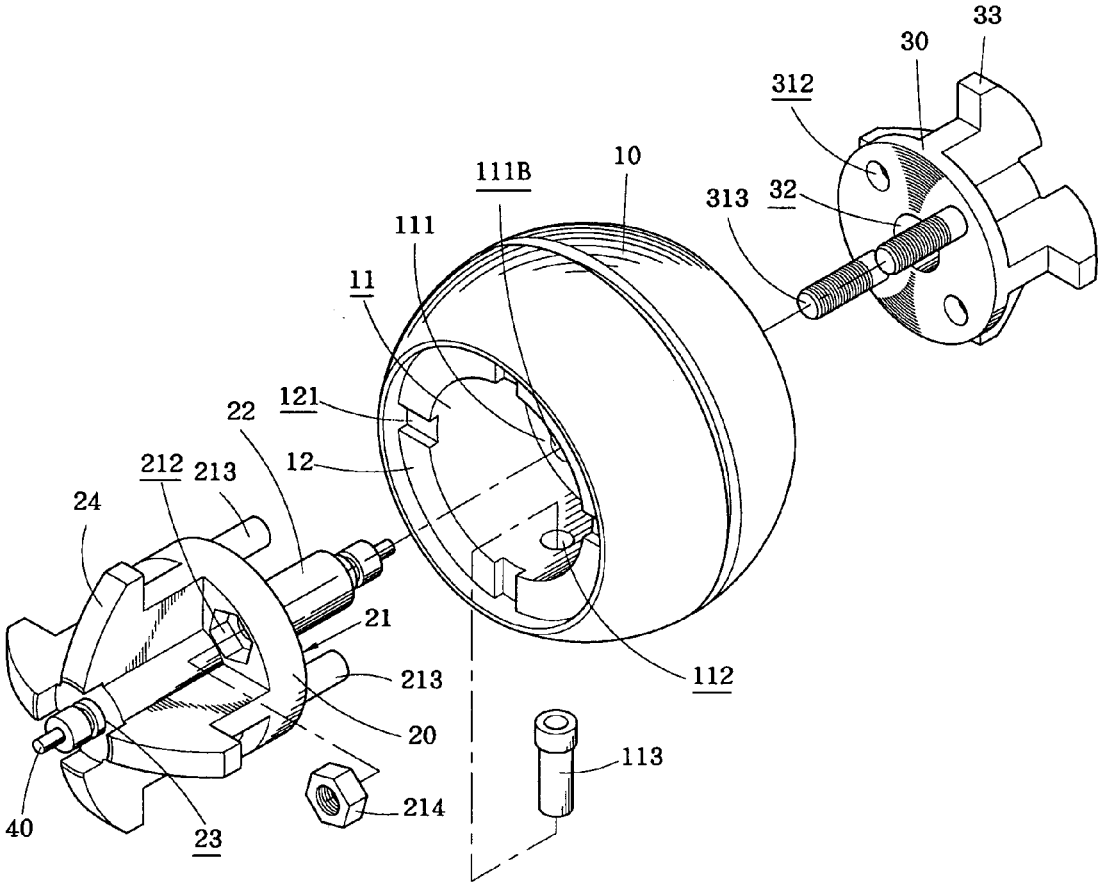
FIG. 5 is an exploded view of a rotor constructed in accordance with a second embodiment of the present invention.
Figure 6:
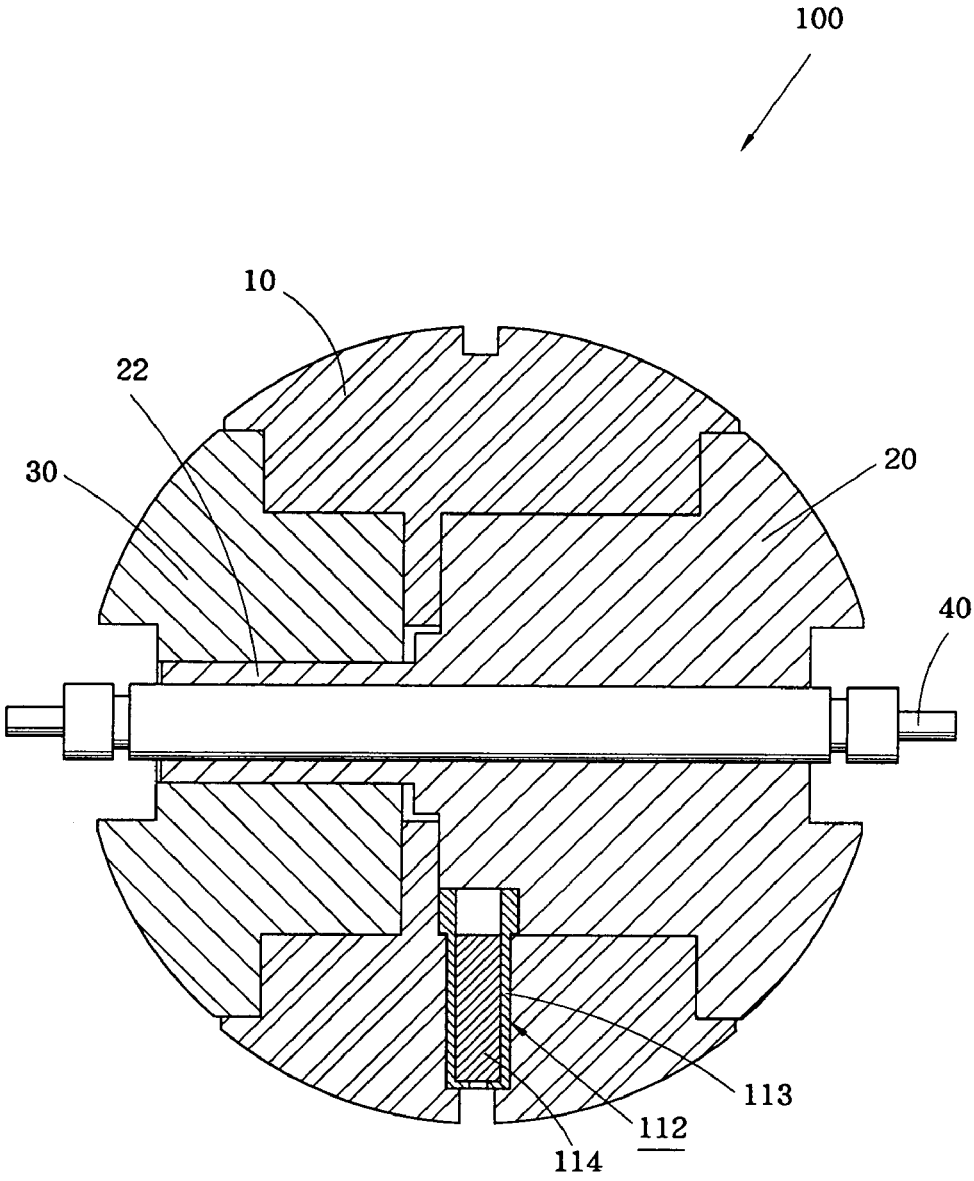
FIG. 6 is a cross-sectional view of the rotor of the second embodiment in accordance with the present invention.

Also referring to FIGS. 5 and 6, a rotor constructed in accordance with a second embodiment of the present invention, which is also designated with reference numeral 100, is shown. It is noted that to simplify the description, identical parts of the first and second embodiments of the rotor bear the same reference numerals. The rotor 100 comprises a spherical body 10 defining a bore 11. A radially extending hole 112 is defined in the body 10 and in communication with the bore 11. A cylindrical plug 113 is fit in the hole 112. To prevent the plug 113 from getting off the hole 112, an inner end of the plug 113 is expanded. A magnet 114 is received and fixed in the plug 113, which will be further described.

An inner flange 111 is formed in the bore 11 and extends along an inner circumference of the bore 11. A plurality of holes 111B is defined in the flange 111. First and second weight members 20, 30 are received in the bore 11 and fixed on opposite sides of the flange 111. The first and second weight members 20, 30 each have an inner end portion 21, 31. Through holes 212 are defined in the end portion 21 of the first weight member 20. Each hole 212 receives and fixes a nut or an inner-threaded member 214. Also, positioning pins 213 extend from a surface of the end portion 21 in a direction toward the second weight member 30. The holes 212 and the pins 213 are located in correspondence to the holes 111B defined in the flange 111.

The inner end portion 31 of the second weight member 30 also defines through holes 312, which correspond to the holes 212 and the pins 213 of the first weight member 20. In fitting the first and second weight members 20, 30 in the bore 11 of the body 10, the pins 213 of the first weight members 20 extend through corresponding holes 111B of the flange 111 and the corresponding holes 312 of the second weight member 30 for positioning the first and second weight members 20, 30 in the bore 11. Bolts 313 extend through the remaining ones of the holes 312 of the second weight member 30 and engage the nut 214 that are fixed in the holes 212 of the first weight member 20 to releasably fix the first and second weight members 20, 30 in the bore 11.

The first weight member 20 forms a cylindrical projection 22 and a hole 23 is defined through the first weight member 20 and the projection 22 to receive an axle 40 therein. The second weight member 30 also defines a through hole 32 to receive the projection 22 of the first weight member 20 whereby the axle 40 extends beyond opposite ends of the body 10.

By loosening the bolt-nut pairs 313, 214, the first and second weight members 20, 30 can be removed from the bore 11 and replacement or exchange with counterparts having different weights can be performed readily.

Also referring to FIG. 7, the rotor 100 of the present invention, both the first and second embodiments, is rotatably received in a casing of a wrist exerciser 200. The casing is comprised of upper and lower casing members 230, 220 between which a support ring 210 is interposed and fixed. The ends of the axle 40 of the rotor 100 are rotatably supported by the support ring 210 for rotation inside the casing. A magnetism-based counter 240 is attached to a lower portion of the lower casing member 220 at a position corresponding to the plug 113 for magnetically interaction with the magnet 114 whereby the number of turns of the rotor 100 can be counted.

Figure 8:
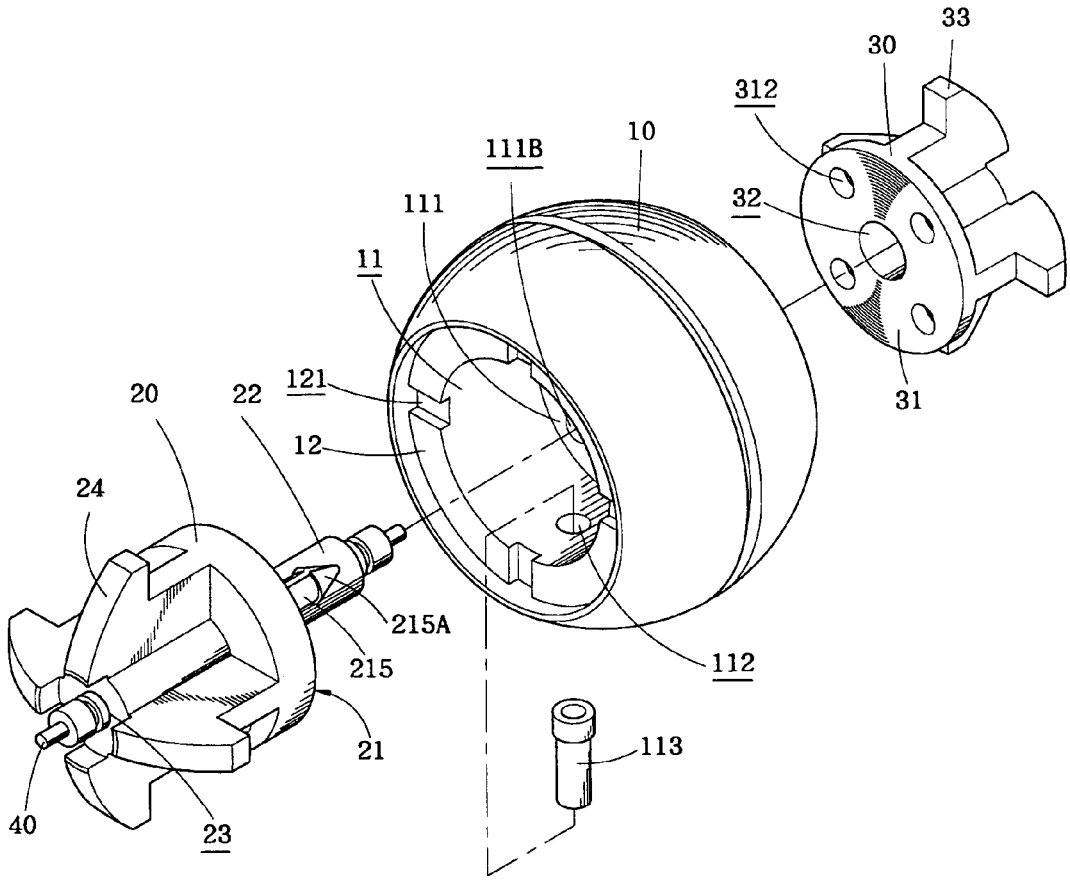
FIG. 8 is an exploded view of a rotor constructed in accordance with a third embodiment of the present invention.

Also referring to FIG. 8, a third embodiment of the rotor in accordance with the present invention, also designated with reference numeral 100, is shown. The rotor of the third embodiment is similar to that of the second embodiment with the bolt-nut pair of the rotor of the second embodiment replaced by snap-on fasteners. The inner end portion 21 of the first weight member 20 no longer defines through holes to receive and fix nuts and the positioning pins are also omitted. Instead, snap-on fasteners 215 extend from the surface of the end portion 21 of the first weight member 20 in a direction toward the second weight member 30. Each snap-on fastener 215 has an expanded, conic end in which at least one diametric slit (not labeled) defined to allow for resilient deformation of the expanded end. Corresponding to each snap-on fastener 215, a hole 312 is defined in the inner end portion 31 of the second weight member 30. The hole 312 is of such a size to receive the conic end of the corresponding fastener 215 by resiliently shrinking the conic end. The resiliency of the conic end resumes the original shape of the conic end thereby engaging the hole 312. This fixes the first and second weight members 20, 30 in the bore 11 of the body 10. By inward deforming the conic ends of the fasteners 215, the fasteners 215 are allowed to disengage from the holes 312 thereby separating the first and second weight members 20, 30 from each other and from the body 10.

Figure 9:
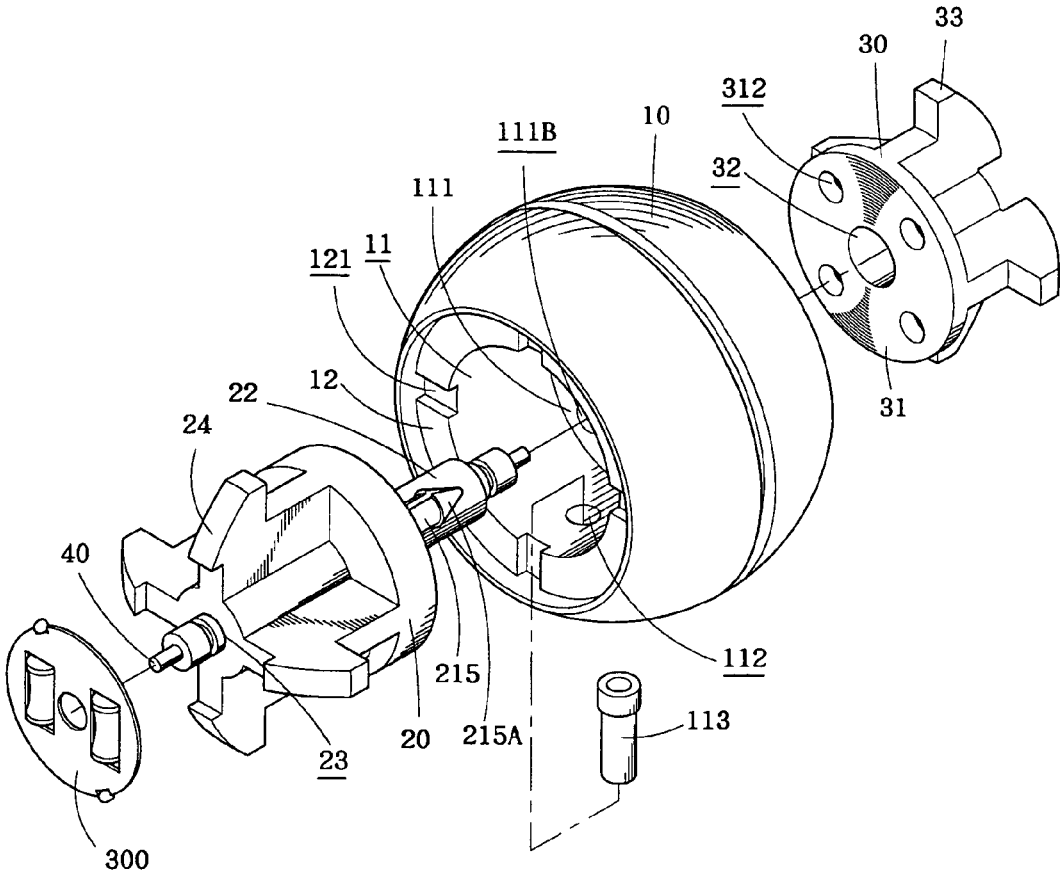
FIG. 9 is an exploded view of a rotor constructed in accordance with a fourth embodiment of the present invention.
Figure 10:
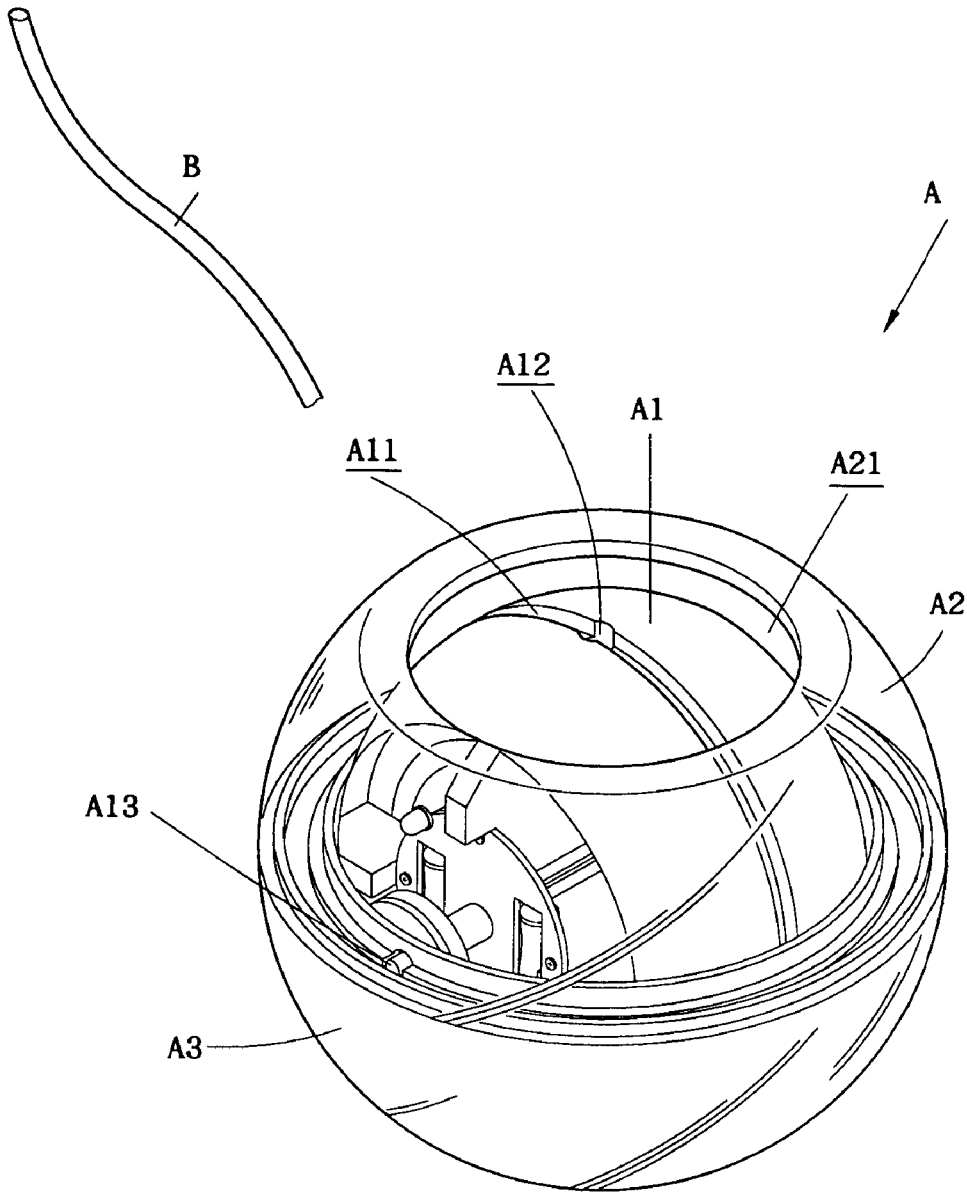
FIG. 10 is a perspective view showing a conventional wrist exerciser.

Also referring to FIG. 9, a fourth embodiment of the rotor in accordance with the present invention, also designated with reference numeral 100, is shown. The fourth embodiment is a modification of the third embodiment in such a way that the first and second weight members 20, 30 of the rotor 100 are made of insulation materials, such as plastics. Electronics are directly mounted to one of the weight members 20, 30 for giving off light and/or sound during the rotation of the rotor 100. In the embodiment, the electronics are embodied as a circuit board 300 that is fixed between the pawls 24 of the first weight member 20. The circuit board 300 comprises an illuminating circuit that can be any known circuit in the art. Thus, when the rotor 100 rotates inside the casing of the wrist exerciser, light is emitted from lighting elements, such as light-emitting diodes, comprised of the illuminating circuit. If desired, sound may be properly given off by incorporating sound-generating elements in the circuit board 300.

The electronics may be selectively mounted to either one of the weight members 20, 30. In the embodiment illustrated in FIG. 9, the circuit board comprising the electronics is directly mounted to the first weight member 20, but it is apparent to mount the circuit board to the second weight member 30 and still having the lighting and sounding effect.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A wrist exerciser comprising:

a casing to be grasped by a user;

a rotor rotatably received in said casing, said rotor further comprising:

a spherical body defining a bore having an inner circumference along which an inner flange extends, the flange having first and second surfaces;

a first weight member received in the bore and having an inner end portion releasably attached to the first surface of the flange, a first through hole defined in the first weight member;

a second weight member received in the bore and having an inner end portion releasably attached to the second surface of the flange, a second through hole defined in the second weight member; and an axle extending through the first and second through holes of the first and second weight members and having ends extending beyond opposite ends of the body;

whereby said first or second weight members being detachable to permit attachment of one or more of a plurality of weight members.

2. The rotor as claimed in claim 1, wherein a through hole is defined in the body.

3. The rotor as claimed in claim 2 further comprising a plug received in the through hole of the body.

4. The rotor as claimed in claim 3, wherein the plug receives and fixes a magnet element therein.

5. The rotor as claimed in claim 1, wherein the body has a sidewall having opposite ends in which recesses are defined.

6. The rotor as claimed in claim 1, wherein through holes are defined in the flange of the body.

7. The rotor as claimed in claim 1 further comprising securing means mounted to the first and second surfaces of the flange.

8. The rotor as claimed in claim 7, wherein the securing means comprises Velcro pads and adhesive tapes.

9. The rotor as claimed in claim 1, wherein the first weight member comprises counterpart securing means.

10. The rotor as claimed in claim 9, wherein the counterpart securing means comprises Velcro pads and adhesive tapes.

11. The rotor as claimed in claim 2, wherein the first weight member comprises projection extending from the inner end portion and fitting into the second through hole of the second weight member.

12. The rotor as claimed in claim 1, wherein the inner end portion of the first weight member comprises positioning pins and defines through holes.

13. The rotor as claimed in claim 12, wherein each through hole defined in the inner end portion of the first weight member receives and fixes an inner-threaded member.

14. The rotor as claimed in claim 1, wherein the inner end portion of the first weight member comprises snap-on fasteners.

15. The rotor as claimed in claim 14, wherein each snap-on fastener has an expanded conic end that is deformable.

16. The rotor as claimed in claim 1, wherein the first weight member has an outer end portion forming pawls.

17. The rotor as claimed in claim 16 further comprising a circuit board received and fixed between the pawls.

18. The rotor as claimed in claim 1, wherein the second weight member comprises counterpart securing means.

19. The rotor as claimed in claim 18, wherein the counterpart securing means comprises Velcro pads and adhesive tapes.

20. The rotor as claimed in claim 1, wherein the inner end portion of the second weight member defines through holes.

21. The rotor as claimed in claim 20 further comprising bolts extending through the through holes.

22. The rotor as claimed in claim 1, wherein the second weight member has an outer end portion forming pawls.

* * * * *